US008419469B2

(12) United States Patent
Montena

(10) Patent No.: US 8,419,469 B2
(45) **Date of Patent: *Apr. 16, 2013**

(54) AUDIO JACK CONNECTOR DEVICE AND METHOD OF USE THEREOF

(75) Inventor: Noah Montena, Syracuse, NY (US)

(73) Assignee: PPC Broadband, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/157,763

(22) Filed: Jun. 10, 2011

(65) Prior Publication Data

US 2011/0237110 A1 Sep. 29, 2011

Related U.S. Application Data

(63) Continuation-in-part of application No. 12/540,683, filed on Aug. 13, 2009, now Pat. No. 7,997,929, and a continuation-in-part of application No. 12/556,500, filed on Sep. 9, 2009, now Pat. No. 8,016,615, and a continuation-in-part of application No. 12/556,512, filed on Sep. 9, 2009, now Pat. No. 8,303,339.

(51) Int. Cl.
*H01R 9/05* (2006.01)

(52) U.S. Cl.
USPC ..... 439/578; 439/580; 439/585

(58) Field of Classification Search ..... 439/578, 439/579, 580, 668, 669, 585, 568
See application file for complete search history.

(56) References Cited

U.S. PATENT DOCUMENTS 2,238,834 A 4/1941 Travers
2,449,983 A 9/1948 Devol
2,761,110 A 8/1956 Edlen et al.
3,184,706 A 5/1965 Atkins
3,336,563 A 8/1967 Hyslop
3,683,320 A 8/1972 Woods et al.
3,706,958 A 12/1972 Blanchenot
4,261,632 A 4/1981 Narozny (Continued)

FOREIGN PATENT DOCUMENTS

DE 4229812 C1 3/1994

OTHER PUBLICATIONS

Notice of Allowance-1 (Mail Date Dec. 29, 2010) for U.S. Appl. No. 12/540,683, filed Aug. 13, 2009; Confirmation No. 1822.

(Continued)

*Primary Examiner* — Renee S Luebke
*Assistant Examiner* — Harshad Patel
(74) *Attorney, Agent, or Firm* — Schmeiser, Olsen & Watts, LLP

(57) ABSTRACT

A phone plug style audio jack connector device having an audio jack and a connector, the audio jack having a socket adapted to receive the tip end of the phone style audio plug. The device is movable between an unassembled position and an assembled position. When the device is in the unassembled position, a prepared coaxial cable end can be inserted into the rear end of the device. When a user moves the device into its assembled position, a fastener is driven to clamp around the cable in the radially inwards direction, thereby forming a connector/cable assembly. The electrical connections, or conduction paths, that run through the connector device are preferably coaxial, and connectors according to the present invention also provide good coaxial shielding within the connector device itself.

2 Claims, 11 Drawing Sheets

U.S. PATENT DOCUMENTS 4,352,240 A 10/1982 Komada
4,374,458 A 2/1983 Komada
4,553,806 A 11/1985 Forney, Jr. et al.
4,557,546 A 12/1985 Dreyer
4,688,877 A 8/1987 Dreyer
4,789,355 A 12/1988 Lee
4,799,902 A 1/1989 Laudig et al.
5,066,248 A 11/1991 Gaver, Jr. et al.
5,073,129 A 12/1991 Szegda
5,154,637 A 10/1992 Klug et al.
5,261,839 A 11/1993 Franks, Jr.
5,318,458 A 6/1994 Thorner
5,362,251 A 11/1994 Bielak
5,470,257 A 11/1995 Szegda
5,527,190 A 6/1996 Weingartner
5,890,925 A 4/1999 Bernardini
5,997,350 A 12/1999 Burris et al.
6,109,963 A * 8/2000 Follingstad et al. ..... 439/578
6,116,945 A 9/2000 Davis et al.
6,123,567 A 9/2000 McCarthy
6,149,469 A 11/2000 Kim
6,153,830 A 11/2000 Montena
6,179,656 B1 1/2001 Wong
6,210,222 B1 4/2001 Langham et al.
6,254,430 B1 7/2001 Endo et al.
6,261,126 B1 7/2001 Stirling
6,331,123 B1 12/2001 Rodrigues
6,517,379 B2 2/2003 Leve
6,558,194 B2 5/2003 Montena
6,568,964 B2 5/2003 D'Addario
6,575,784 B1 6/2003 Yamada
6,644,993 B2 11/2003 Victor
6,676,446 B2 1/2004 Montena
6,705,884 B1 3/2004 McCarthy
6,722,902 B2 4/2004 Kedzierski
6,729,912 B2 5/2004 D'Addario
6,749,454 B2 6/2004 Schmidt et al.
6,764,350 B2 7/2004 Kosmala
6,786,774 B2 9/2004 Haas, II et al.
6,848,940 B2 2/2005 Montena
6,860,760 B2 3/2005 Endo et al.
6,884,113 B1 4/2005 Montena
6,966,796 B2 11/2005 Abe et al.
7,029,326 B2 4/2006 Montena
7,048,579 B2 5/2006 Montena
7,094,103 B2 8/2006 Lai
7,121,872 B1 10/2006 Hanks
7,153,159 B2 12/2006 Burris et al.
7,156,695 B2 1/2007 Holliday
D542,225 S 5/2007 Victor
7,217,155 B2 5/2007 Montena
7,226,320 B2 6/2007 Abe et al.
7,311,554 B1 12/2007 Jackson et al.
7,458,849 B2 * 12/2008 Rodrigues et al. ..... 439/578
7,458,851 B2 12/2008 Montena
7,476,119 B2 1/2009 D'Addario et al.
7,488,187 B2 2/2009 Wolf
7,841,898 B1 11/2010 Titus
7,857,643 B2 12/2010 Dobler
7,997,929 B2 8/2011 Montena
8,016,615 B2 * 9/2011 Montena ..... 439/580
2003/0207620 A1 11/2003 Haas, II et al.
2003/0224658 A1 12/2003 Koch et al.
2005/0085125 A1 * 4/2005 Montena ..... 439/578
2005/0164553 A1 7/2005 Montena
2006/0014425 A1 1/2006 Montena
2006/0063426 A1 3/2006 Khemakhem et al.
2006/0194474 A1 8/2006 Montena
2008/0045082 A1 2/2008 Kuo
2008/0261445 A1 10/2008 Malloy et al.
2009/0186503 A1 7/2009 Dobler
2009/0233482 A1 9/2009 Chawgo et al.
2010/0144183 A1 6/2010 Nania et al.
2010/0203760 A1 8/2010 Montena
2010/0261381 A1 10/2010 Montena et al.
2011/0039449 A1 2/2011 Montena
2011/0059648 A1 3/2011 Montena
2011/0059649 A1 3/2011 Montena
2011/0300747 A1 12/2011 Montena
2011/0306226 A1 12/2011 Montena
2011/0306247 A1 12/2011 Montena
2012/0003870 A1 1/2012 Montena
2012/0094521 A1 4/2012 Montena
2012/0135629 A1 5/2012 Montena

OTHER PUBLICATIONS

Notice of Allowance-2 (Mail Date Apr. 11, 2011) for U.S. Appl. No. 12/540,683, filed Aug. 13, 2009; Confirmation No. 1822.
Office Action (Mail Date Jun. 21, 2010 for U.S. Appl. No. 12/540,683, filed Aug. 13, 2009; Confirmation No. 1822.
Notice of Allowance (Mail Date May 11, 2011) for U.S. Appl. No. 12/556,500, filed Sep. 9, 2009; Confirmation No. 2669.
Office Action (Mail Date Dec. 13, 2010 for U.S. Appl. No. 12/556,500, filed Sep. 9, 2009; Confirmation No. 2669.
U.S. Appl. No. 13/209,587, filed Aug. 15, 2011.
U.S. Appl. No. 13/231,011, filed Sep. 13, 2011.
Office Action (Mail Date: Sep. 14, 2011) for U.S. Appl. No. 12/556,512, filed Sep. 9, 2009.
U.S. Appl. No. 12/955,978, filed Nov. 30, 2010.
U.S. Appl. No. 13/152,431, filed Jun. 3, 2011.
Office Action (Mail Date Feb. 13, 2012 for U.S. Appl. No. 13/209,587, filed Aug. 15, 2011.
Office Action (Mail Date Dec. 16, 2011 for U.S. Appl. No. 13/231,011, filed Sep. 13, 2011.
Final Office Action (Mail Date Apr. 4, 2012 for U.S. Appl. No. 13/231,011, filed Sep. 13, 2011.
Notice of Allowance (Mail Date Jul. 10, 2012 for U.S. Appl. No. 12/556,512, filed Sep. 9, 2009.
Final Office Action (Mail Date Apr. 12, 2012 for U.S. Appl. No. 12/556,512, filed Sep. 9, 2009.
Notice of Allowance (Mail Date Jun. 15, 2012 for U.S. Appl. No. 13/209,587, filed Aug. 15, 2011.
Notice of Allowance (Mail Date Jun. 18, 2012 for U.S. Appl. No. 13/231,011, filed Sep. 13, 2011.

* cited by examiner

AUDIO JACK CONNECTOR DEVICE AND METHOD OF USE THEREOF

CROSS REFERENCE TO RELATED APPLICATIONS

This application is a continuation-in-part of and claims priority to U.S. patent application Ser. No. 12/540,683 filed Aug. 13, 2009; this application is a continuation-in-part of and claims priority to U.S. patent application Ser. No. 12/556,500 filed Sep. 9, 2009; and this application is a continuation-in-part of and claims priority to U.S. patent application Ser. No. 12/556,512, filed Sep. 9, 2009; all of which are hereby incorporated by reference in their entirety.

TECHNICAL FIELD

Embodiments of the present invention relate generally to multi-conductor coaxial cable connectors, more particularly to audio connectors and even more particularly to three conductor audio connectors.

BACKGROUND

Various multi-conductor cables incorporate multiple electrically isolated conductive strands bound together in a single cable. Often multi-conductor cables have a pair of twisted wires surrounded by a braided shield. Multi-conductor cables can also be arranged so that each of the conductive stands are oriented about each other so as to concentrically share a common axis, and may be referred to in a manner that reveals the common axial relationship, (e.g. triaxial cable). Common audio jack connectors, used to connect audio sources, such as an electric guitar, to sound processing equipment, such as an amplifier or an effect/distortion pedal, utilize multiple electrically isolated terminal contacts corresponding to the multiple conductive strands of the multi-conductor cable. Typically, each of the conductive strands of a multi-conductor cable is soldered to respective terminal contacts of a corresponding common audio jack connector. However, soldering can be difficult and time consuming even for experienced technicians, usually requiring special knowledge and precautions for safe implementations. For instance, there is always a possibility that any of the conductive strands of the cable may end up soldered to the wrong conductive terminal contact of the connector, resulting in undesirable sound quality.

Thus, a need exists for an apparatus and method for efficiently ensuring proper connection of the multiple conductive strands of a multiple-conductor cable, while also eliminating the time consuming and potentially harmful aspects of soldering.

SUMMARY

A first aspect relates to an audio coaxial connector (e.g. an audio coaxial connector having an impedance rating of less than 50 ohms) that includes a deformable member. Specifically, a coaxial cable connector device for assembly with the prepared end of a coaxial audio cable having at least a first conductor and a second conductor, and for attachably detachable use with corresponding, mating audio connection audio hardware, the device comprising: audio connection hardware configured to form an attachably detachable connection with the corresponding, mating connection audio connection hardware, a first conduction path established by an electrical connection between the first conductor of the coaxial audio cable and a first portion of the audio connection hardware, a second conduction path established by an electrical connection between the second conductor of the coaxial audio cable and a second portion of the audio connection hardware, and a deformable member configured to clamp the cable in an assembled position.

A second aspect relates to a coaxial cable connector device for assembly with the prepared end of a coaxial cable having at least a first conductor, a second conductor and a third conductor, and for attachably detachable use with corresponding, mating connection hardware, the device comprising connection hardware forming an attachably detachable connection with the corresponding, mating connection hardware, a first conduction path formed by electrically connecting the first conductor of the coaxial cable to a first portion of the connection hardware, a second conduction path formed by electrically connecting the second conductor of the coaxial cable to a second portion of the connection hardware, a third conduction path formed by electrically connecting a third conductor of the coaxial cable to a third portion of the connection hardware, and a deformable member configured to clamp the cable in an assembled position A third aspect relates to a coaxial cable connector device for assembly with the prepared end of a coaxial cable having at least a first conductor and a second conductor and for attachably detachable use with a single pronged plug, the device comprising a jack having a first contact, a second contact and an interior surface that defines an interior space, the jack configured to form an attachably detachable connection with the plug so that the single prong of the plug is accommodated within the interior space, a first conduction path formed by electrically connecting the first conductor of the coaxial cable to the first contact of the jack, a second conduction path formed by electrically connecting the second conductor of the coaxial cable to the second contact of the jack, and a deformable member that is configured to cause clamping of the coaxial cable when in an assembled position, wherein the first contact of the jack forms a portion of the interior surface and faces the interior space, wherein the second contact of the jack forms a portion of the interior surface and faces the interior space.

A fourth aspect relates to a coaxial cable connector device for assembly with the prepared end of a coaxial cable having at least a first conductor and a second conductor, and for attachably detachable use with corresponding, mating connection hardware, the device comprising a connection hardware sub-assembly comprising a first fastener, a connection hardware set that defines an axial direction, a radial direction and an angular direction, a first conduction path, and a second conduction path; and a compression band member, wherein the connection hardware set is configured to form an attachably detachable connection with the corresponding, mating connection hardware, wherein the first conduction path is formed by electrically connecting the first conductor of the coaxial cable to a first portion of the connection hardware set, wherein the second conduction path is formed by electrically connecting the second conductor of the coaxial cable to a second portion of the connection hardware set.

BRIEF DESCRIPTION OF THE DRAWINGS

Embodiments of the present invention will be more fully understood and appreciated by reading the following Detailed Description in conjunction with the accompanying drawings, in which.

DETAILED DESCRIPTION

I. Embodiments of FIGS. 11 and 12

Figure 11:
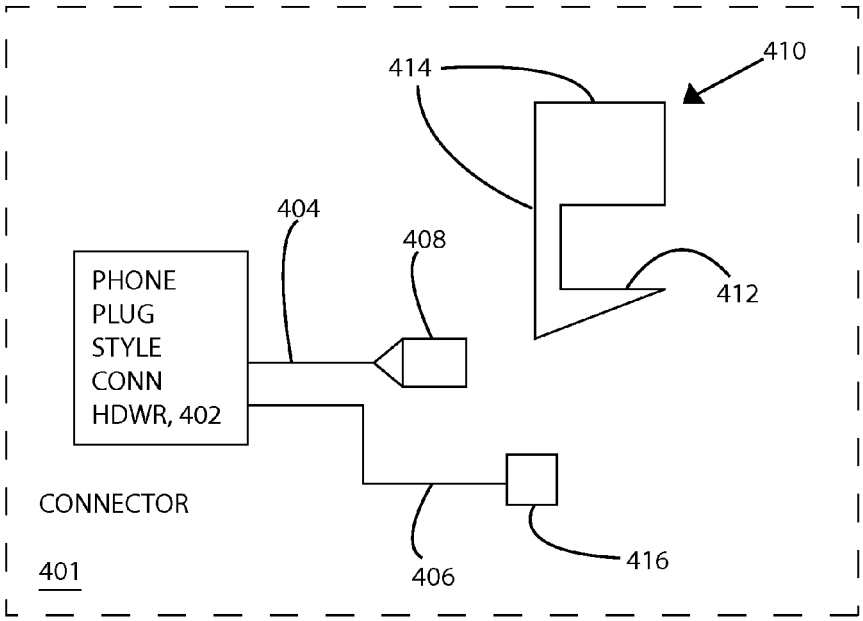
FIG. 11 is a somewhat schematic, cross-sectional view (cross-hatching omitted for clarity of illustration) of an audio coaxial connector.
Figure 12:
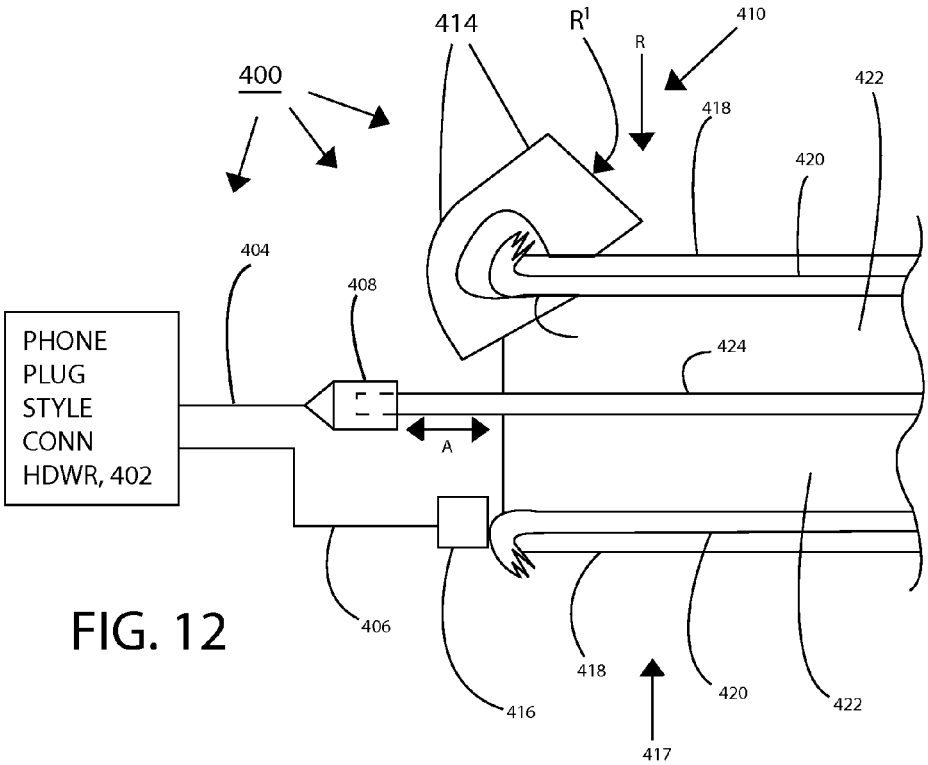
FIG. 12 is a somewhat schematic, cross-sectional view (cross-hatching omitted for clarity of illustration) of an audio coaxial cable/connector sub-assembly using the connector of FIG. 11.

The cable/connector embodiment 400 of FIGS. 11 and 12 is not necessarily preferred, but is presented first in order to facilitate understanding of some of the basics. As shown in FIGS. 11 and 12, cable/connector system 400 includes phone plug style connector 401 and phone plug compatible cable end 417. Connector 401 includes phone plug style connector hardware 402; inner current path 404; outer current path 406; inner contact 408; deformable member 410 (including deforming portion 414 and clamping surface 412); and outer contact 416. Cable end 17 includes: outer insulative layer 418; outer current path 420; inner insulative layer 422; and inner current path 424.

In order to assemble the connector/cable system 400: (i) cable end 417 and connector 401 are moved toward each other in axial direction A so that the inner and outer current paths 420,424 of the cable end make electrical contact with the contacts 416,408 of the connector as shown in FIG. 12; and (ii) deforming portion 414 of deformable member 410 is deformed in direction R'; and (iii) the deformation is continued until a portion of the cable end is clamped between deforming portion 414 and clamping surface 412. In this embodiment, the clamping force exerted by the deformation of the deformable member is substantially in the inwards radial direction R, which is preferred. In this embodiment, the clamping force does not extend around the cable end all the way around its angular direction, but this is not preferred. As will be seen in later embodiments, it is preferable to clamp the cable end at least substantially 360 degrees around in the angular direction. The outer conduction path 406 of connector 401 does not extend all the way around the connector in the angular direction, which is also not preferred for electrical performance reasons.

System 400 is a TS system because it has phone plug style connection hardware and only two coaxial current paths. In other embodiments of the present invention, there may be three (TRS), for (TRRS), or even more coaxial current paths. In various embodiments of the present invention, there may be phone plug style connection hardware that is plug (male) or jack (female or socket). In other embodiments of the present invention, the phone plug style connection hardware may be replaced by other types of audio coaxial cable connector hardware (that is connector styles not susceptible to being made with a 50 ohm, or greater, impedance rating). In phone plug style embodiment, the phone plug may be made at various standard sizes (standards now known or to be developed in the future).

In embodiment 400, deformable member 410 is sized, shaped, located and/or structured so that it can be deformed, and undeformed, by hand, without using a special tool. Other embodiments of the present invention may require a special tool to be deformed and undeformed. Also, other embodiments may not allow the deformable member to be undeformed without destroying it. In embodiments where the deformable member can be undeformed without destroying it, the cable end can be released from the cable so that the connector and/or cable can be reused in other cable assemblies, or re-cut to a shorter cable length.

II. Embodiments of FIGS. 1-7

Figure 1:
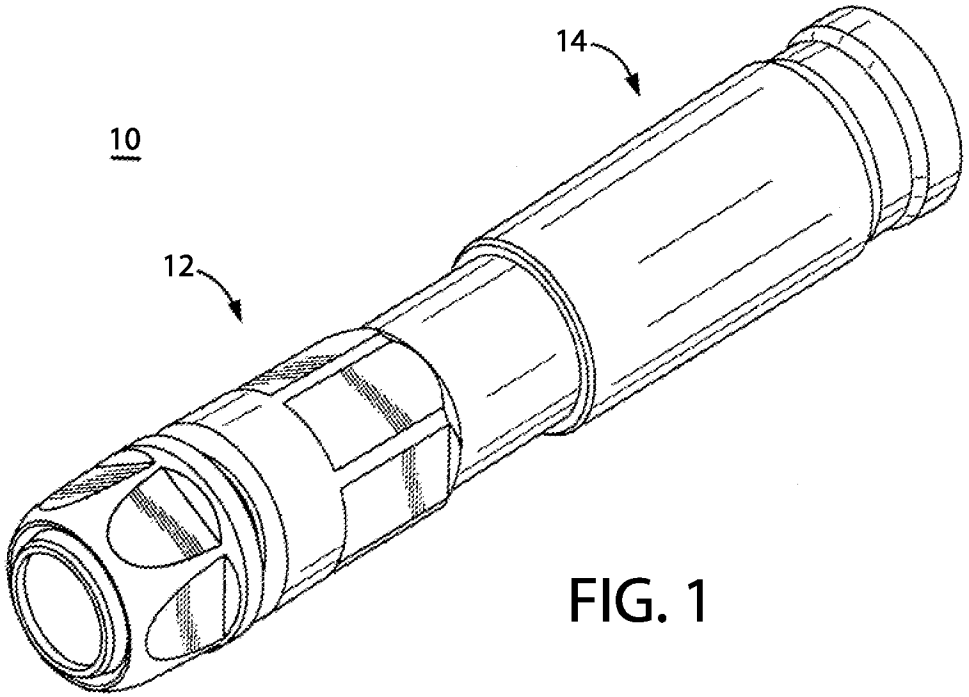
FIG. 1 is a perspective view of an embodiment of an audio jack connector device.
Figure 2:
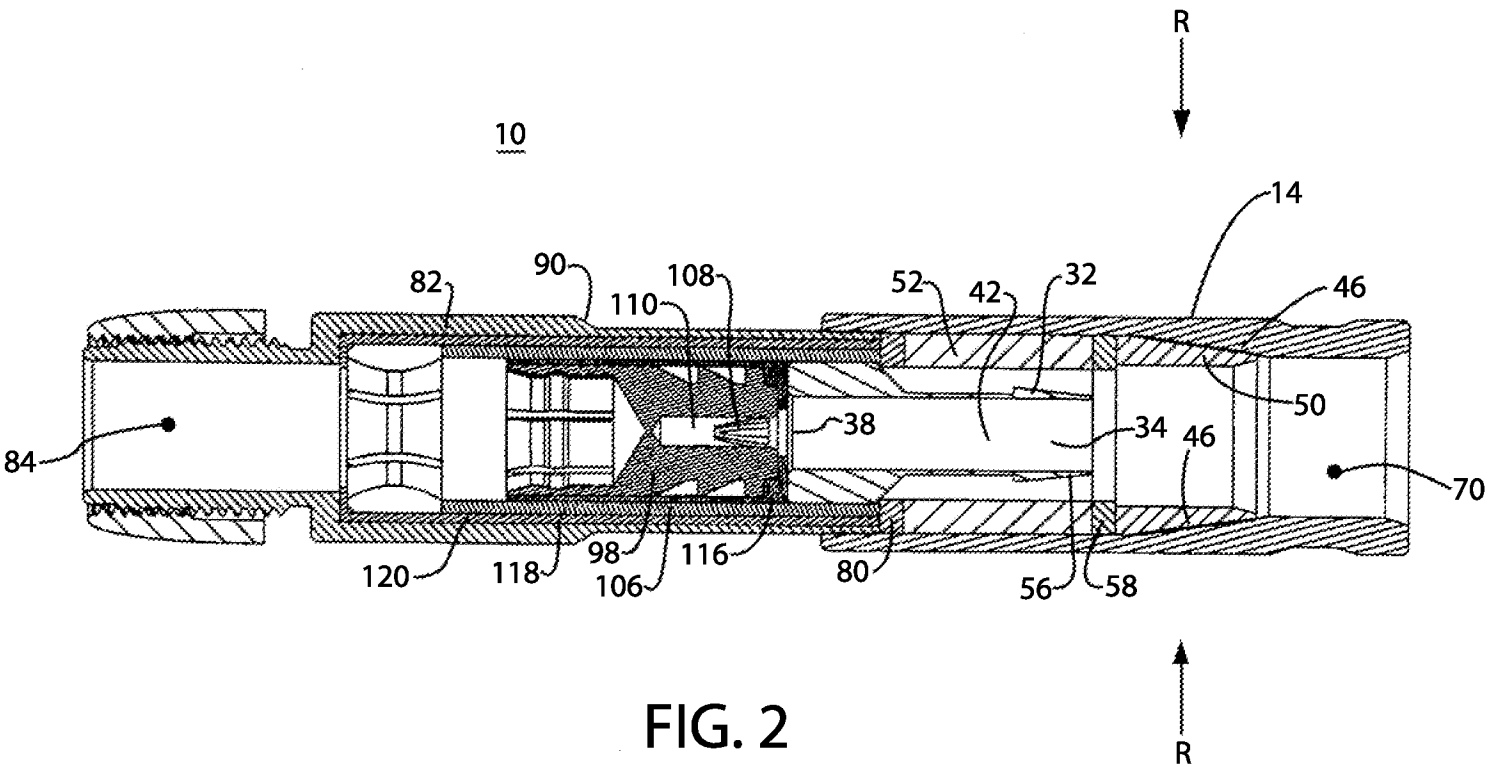
FIG. 2 is a sectional view of the audio jack connector device of FIG. 1.

The cable/connector system shown in FIGS. 1-7 includes: device 10 (the connector; and cable end 18. Cable end 18 (sometimes called prepared end 18) includes: first conductor 20; first insulation layer 24; second conductor 22; second insulation layer 26; third conductor 28; and third insulation layer 30. As shown in FIG. 1, audio jack connector device 10 includes two major components: audio jack sub-assembly 12 at one end; and connector 14 at the opposite end. As shown in FIGS. 2 (assembled view) and 4 (exploded view), jack sub-assembly 12 includes: tubular body (or post) 32; post first section 32*a*; post second section 32*b*; post third section 32*c*; first opening 34; first end 36; second opening 38; second end 40; first inner cavity 42; first flange (or raised lip) 44; second flange (or raised lip) 48; first fastener (or annular clamp) 50; tube 52; first outer cavity 56; first washer 58; slot (or opening) 60; first end 62; second end 64; second washer 80; socket body 82; opening (or socket interior space) 84; first section 86; second section (or exterior stepped section) 88; third section 92; mechanically interlocking features 94; nut 96; contact body 98; first end 100; second end 102; slits 104; insulator 106; electrical socket component 108; bore 110; first end 112; second end 114; inwardly facing flange 116; inner housing 118; slots 119 and insulator 120. In addition to jack sub-assembly 12, FIGS. 2 and 4 also show connector 14, which includes: inclined surface 46; first end 66; second end 68 and connector interior space 70.

As will be explained in greater detail below, during assembly, the connector portion 14 of device 10 slides in the axial direction over the jack portion 12 of device 10. This sliding causes a physical interference that works to deform a deformable member in the jack portion, and this deformation clamps a portion of cable end 18. Device 10 is can be provided as a pre-assembled assembly including both jack sub-assembly 12 and connector 14, which reduces the number of separate pieces that must be handled during shipping and installation and thereby makes shipping and installation somewhat easier.

Figure 3:
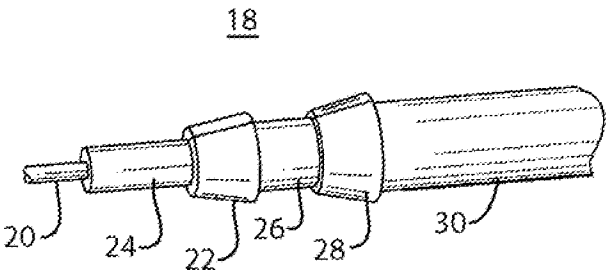
FIG. 3 is a perspective view of a multi-conductor coaxial cable.

The embodiment of FIGS. 1-7 is a phone plug style connector, and more specifically a TRS or audio jack style connector. However, device 10 may not necessarily be limited to audio connectors, but require that the connector have three or more conduction paths. Preferably, these three or more conduction paths are maintained in a coaxial configuration even within the connector device itself. Similarly, device 10 may not necessarily be limited to three conductor cable/connectors (e.g. a jack for a single prong plug). Another embodiment is a TRS phone plug style jack connector device. This means that, as shown in FIG. 3, the prepared end 18 of the coaxial cable has three (3) coaxial conductors. For example, the prepared end of the coaxial cable 18 may include a center conductor 20, a first conductive strand layer 22 and a second conductive strand layer 28. The prepared end 18 is inserted through the end of connector 14 and into the interior space of jack sub-assembly 12. As will be discussed in more detail below, after the prepared end of the coaxial cable has been inserted into device 10, connector 14 is moved, relative to jack sub-assembly 12 and also to the prepared end of the coaxial cable, in the axial direction A (see FIG. 5). As will be explained in more detail below, connector 14 and the various components of jack sub-assembly 12 are sized and shaped so that, as the connector 14 slides in axial direction A, it will exert a compressive force in an inwards radial direction R on both the components of jack sub-assembly 12 and the prepared end of the coaxial cable which has been inserted into the jack subassembly. This inwards radial compressive force exerted by connector 14 serves to secure the prepared end of the coaxial cable inside of device 10, and also to prevent connector 14 from sliding back in the A' direction (see FIG. 5) so that the compressive force is released. In this way, an at least somewhat permanent mechanical and electrical connection can be achieved between a prepared end 18 of a coaxial cable and connection hardware so that the end of the cable can form detachably attachable mechanical and electrical connections with other audio or TRS style plugs of a compatible size.

Figure 5:
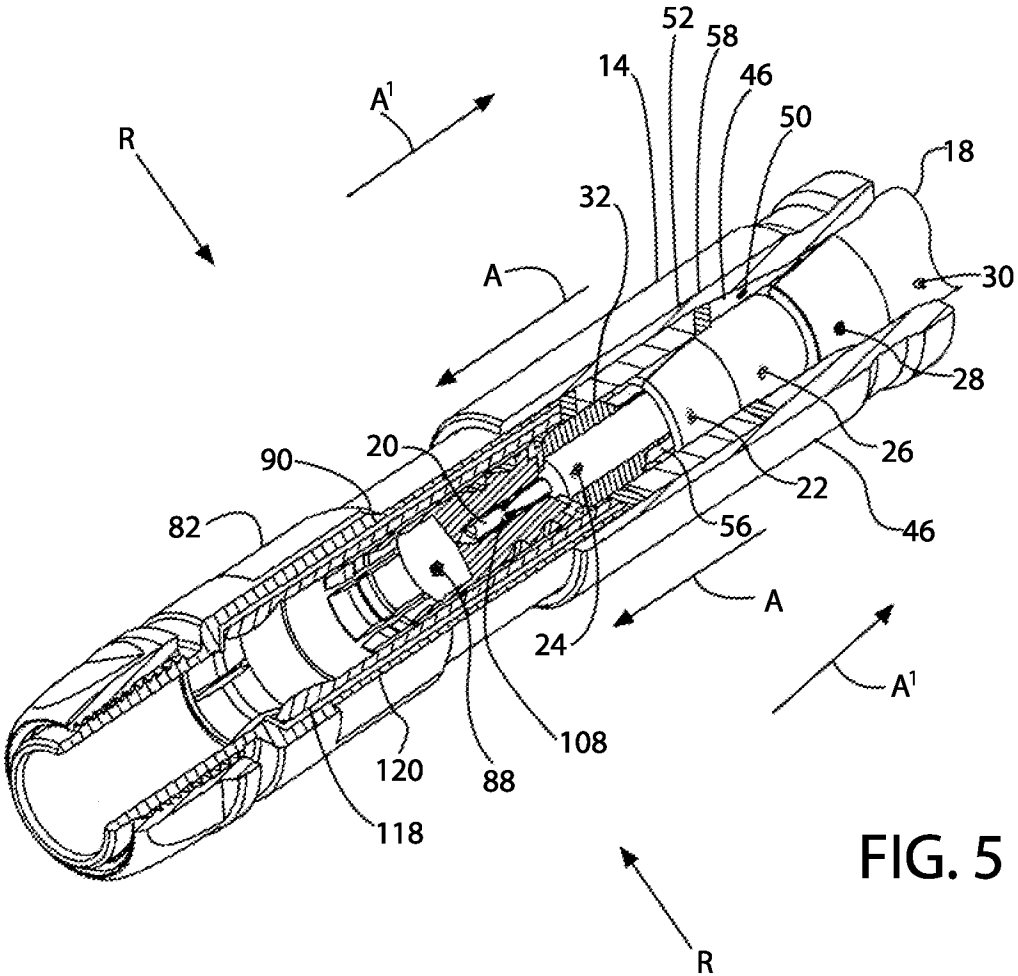
FIG. 5 is a sectional view of the audio jack connector device of FIG. 1 with a multi-conductor coaxial cable positioned therein.
Figure 6:
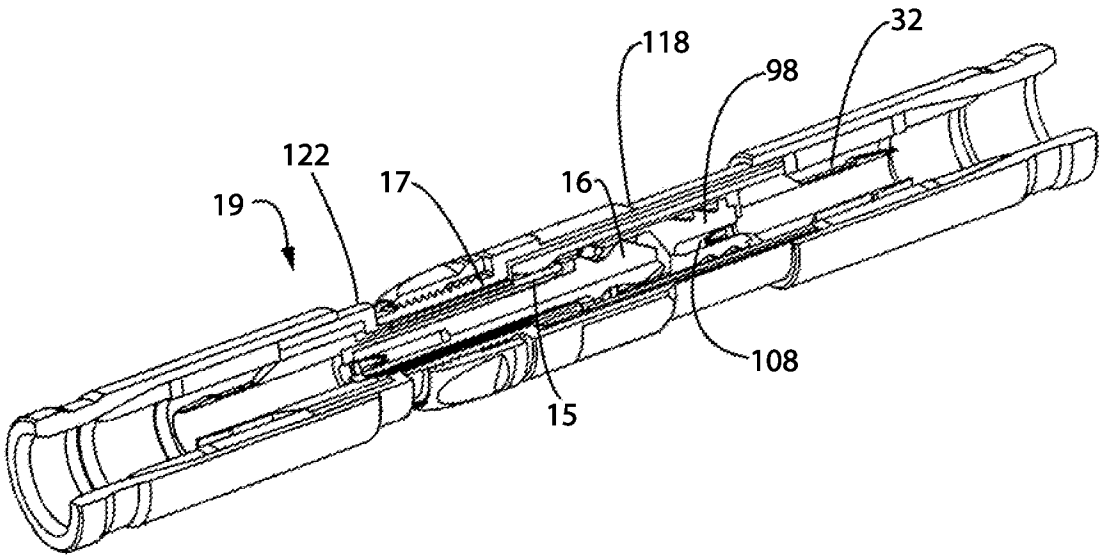
FIG. 6 is a sectional view of the audio jack connector device of FIG. 1 with an audio plug shown positioned therein.

With continued reference to the drawings, the electrical conduction paths from cable end 18, through jack portion 12 and to a connected TRS or audio plug will now be explained. After cable end 18 has been assembled with device 10, a first conductor 20 (e.g. a center conductor) of the cable can be electrically connected to electrical socket component 108 and contact body 98 of device 10, as best shown in FIGS. 2 and 5. As shown in FIG. 6, contact body 98 is sized and shaped to accommodate a male connection with tip 16 of TRS plug 19, thereby defining the innermost, or center, conduction path through the jack from the cable to mated plug 19. In this embodiment, the innermost conduction path may always be maintained along a central axis of the cable and connectors, which can improve electrical performance. A second conductor 22 (e.g. a first conductive braid/sheath layer) of the cable can be electrically connected to post 32, which can be electrically connected to inner housing 118, which can be electrically connected to a second conductor path 17 in mated plug 19, as shown in FIGS. 2, 5 and 6. The second conduction path may be structured to extend coaxially around the first conduction path, at least substantially 360 degrees around the angular direction, as defined by the cable and connectors. a third conductor 28 (e.g. second conductive braid/sheath layer) of the cable can be electrically connected coaxially through device 10 to a third conductor path 122 in mated plug 19, as shown in FIGS. 2, 5 and 6. The third conduction path may be structured to extend coaxially around the second conduction path, at least substantially 360 degrees around the angular direction to extend a RF shield through the connector.

The assembly of cable end 18 into device 10 to form a connector/cable TRS female jack assembly will now be discussed in more detail. As shown in FIG. 2, before device 10 is assembled with a cable end, device 10 will be in its unassembled position. In the unassembled position, a first fastener 50 of jack portion 12 is accommodated in the interior space 70 of connector 14 so that connector 14 exerts relatively little radially inwards (see arrows R in FIG. 2) force on first fastener 50. That is because inclined surface 46 of connector 14 may be shaped and located to comfortably accommodate the corresponding inclined outer profile of first fastener 50.

Figure 4:
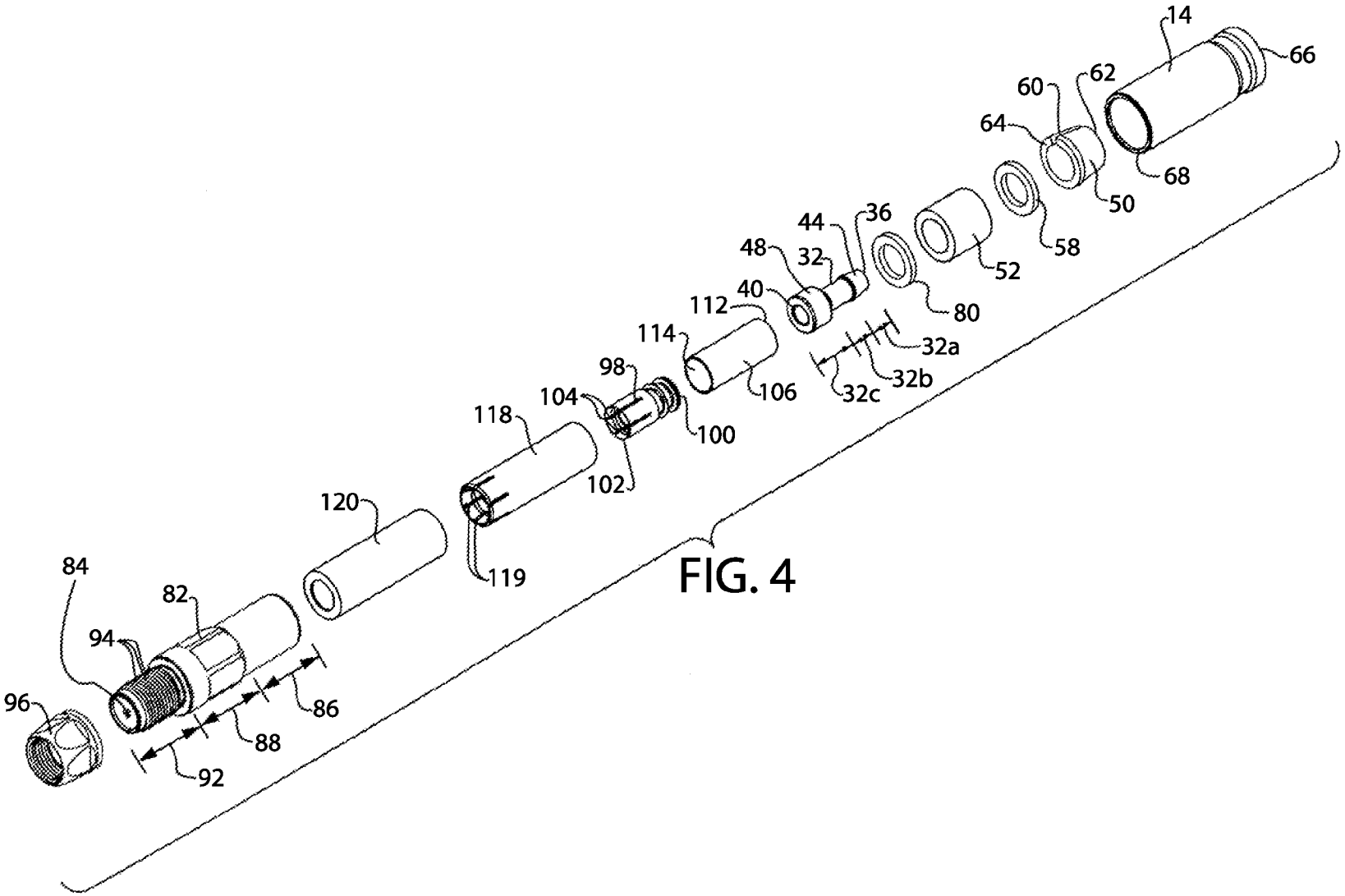
FIG. 4 is an exploded perspective view of the audio jack connector device of FIG. 1.

While device 10 is in its unassembled position, cable end 18 is inserted axially through the rear end of device 10 until first insulator layer 24 of cable 18 is positioned against the end of insulator 106. After cable end 18 is fully inserted in this manner, device 10 is moved from its unassembled position to its assembled position. Specifically, connector 14 is moved axially toward the front end of device 10, preferably by a tool, such as an axial compression tool. As device 10 is manipulated to be in the assembled position, the inclined surface 46 and/or compression band 74 (see FIG. 7) of connector 14 push first fastener 50 in the radially inwards direction R, thereby deforming, or compressing, first fastener 50 to clamp the entirety of the cable end within the interior space of first fastener 50. For example, embodiments of compression band member 74 slides axially over the rest of the connector device (similar to the manner in which a ring slides over a finger). When a compression band portion slides into axial alignment with the deforming member (for example, a slotted annulus), then the compression band deforms the deforming member to put the device in its assembled position and clamp any inserted cable. As shown in FIG. 4, first fastener 50 includes slot 60 to allow it to be compressed and clamp the cable. Other geometries may be possible for first fastener 50.

Moreover, it is possible to move connector 14 back in the A' direction (see FIG. 5, and thereby release the radial inwards compression so that the cable end may be removed from device 10. However, it should not be too easy to move the connector in the A' direction after it is assembled because the connector/cable assembly will need to withstand tensile operating stresses and strains.

With reference to FIGS. 1-7, a multi-conductor cable, such as a triaxial cable, can be secured to device 10 without the need for soldering, crimping or tooling. Prepared end 18 may be a prepared end of a triaxial cable. The first conductor 20 of the multi-conductor cable is commonly referred to as an electrical center conductor. The first conductor 20 is surrounded by and spaced radially inwardly from second conductor 22, which may be in the form of a first braid conductor or first conductive sheath. First insulator layer 24 electrically insulates first conductor 20 and second conductor, and also maintains the spaced apart and coaxial orientation between the first and second conductors. First insulator layer is preferably made of a first dielectric material and is commonly referred to as an insulator core. Second insulator layer 26 can be made of a second dielectric material and is also commonly referred to as an insulator core. Second insulator layer 26 separates, maintains a coaxial orientation between, and electrically insulates second conductor 22 and third conductor 28. Third conductor 28 may be made in the form of braid conductor or conductive sheath. Third insulator layer 30 may be in the form of a dielectric covering or sheathing jacket. Third insulator layer 30 surrounds third conductor 28 (except at its exposed, drawn back end as shown in FIG. 3). In a three conductor TRS embodiment, the third insulator layer is the outermost layer of the cable. The triaxial cable used herein is not limited to that just described and any form of multi-conductor coaxial cable (e.g., cables having sheathing layers composed of multiple or variable layers of sheathing materials, stranded central conductors, dielectric materials of varying thickness, etc., including four-conductor cables, five-conductor cables and the like) may be used. Prior to insertion into device 10, the triaxial cable is prepared by removing various layers, as known in the art, to expose an end of center conductor 20, first dielectric material 24, first conductive sheath 22, second dielectric material 26 and second conductive sheath 28, which is folded over sheathing jacket 30. The insertion of prepared end 18 into the connector device will be discussed in more detail below.

The type of compression used in connector device 10 may be any form including but not limited to configurations set forth in U.S. Pat. Nos. 6,558,194; 6,153,830; 5,470,257; and/or 6,261,126, all of which are hereby incorporated by reference. One embodiment of compression hardware will be discussed in detail below. Embodiments of the compression hardware accomplish its compression of first fastener 50 and the cable when a user moves connector 14 towards the front of jack portion 12, other designs may use other types of component motion to effect the radially inward directed compression that secures the connector device to the coaxial audio cable. As one example, components of the connector device may be moved apart in the axial direction in order to cause the compression. As a further example, the components of the connector device may also be rotated relative to each other, as in embodiments that have a threaded connection between the major components of the connector device, or a protrusion and groove engagement between the major components of the connector device (where the groove has some angular component in its geometry).

The compression configuration used herein can be easily assembled and may be pre-assembled as a single assembly prior to its compressive connection to the prepared end of a coaxial cable. Connector device 10 includes a number of components that fit, press or snap together without the need for soldering. The shape and configuration of the components or pieces that make up a connector device may vary depending upon the way the pieces fit together and/or design choices of the type commonly made by those of skill in the art. The particular components of the jack subassembly 12 of device 10 will be discussed in more detail below. FIGS. 1 through 7 illustrate but one example of a configuration used herein to create connector device 10.

The components of the embodiments of the device can fit together by interference fit and/or or compression, which can be achieved by friction and/or small elastic deformations of contacting parts due to compressive strain, after the parts are pushed together, rather than by extraneous means of fastening, such as adhesives or set screws. "Interference" may refer to the fact that one part slightly interferes with the spatial location of another, and commonly includes arrangements referred to as a press fit.

Referring now to FIG. 4, embodiments of post 32 may include three sections, such as a first section 32*a*, a second or middle section 32*b*, and a third section 32*c*. The first section 32*a* includes a first flange or raised lip 44. The third section 32*c* includes a second flange or raised lip 48.

Post 32 has a first opening 34 at first end 36 and a second opening 38 at second end 40 that defines a first inner cavity 42. As mentioned above jack sub-assembly can be shaped and sized to receive, mechanically connect to and electrically connect to prepared end 18 of a triaxial cable. As best shown in FIGS. 2 and 5, when prepared end 18 is inserted into connector device 10, post 32 receives the first conductor 20 and first insulator 24 portions of prepared end through its first opening 34 and into its first inner cavity 42. However, the second conductor 22 and second insulator 26 portions of prepared end 18 remain radially outwards of post 32. In this way, post 32 serves to maintain mechanical and electrical separation of first conductor 20 from second conductor 22, while maintaining coaxial alignment between these two conduction paths.

As shown further shown in FIGS. 4 and 5, when prepared end 18 is inserted into connector device 10: (i) first conductor 20 is received by electrical socket component 108; (ii) second conductor 22 is received between the radially outwards facing surface of post 32 and the radial inwards facing surface of tube 52 (this space is shown in FIG. 2 as cavity 56); and (iii) third conductor surface is (at least partially) received within the radially inwards facing surface of first annular clamp 50. When the three conductors of prepared end 18 are initially inserted into their respective components of jack subassembly 12 of connector device 10, there is only a relatively loose fit. The fit may be loose enough so that the prepared end could be pulled back out of device 10. As will be explained in more detail below, however, after the user takes the appropriate actions to provide compression using the compression hardware, the connection will, at least in some embodiments, become somewhat permanent.

As best shown in FIGS. 2 and 5, connector 14 surrounds several components of jack sub-assembly 12, including: a portion of first section 86 of socket body 82; second washer 80; tube 52; second washer 58; and first annular clamp 50. Second annular clamp 52 is radially spaced about post 32 to define a first outer cavity 56. Post 32 receives the center conductor 20 and the first dielectric 24 of triaxial cable 18. The first sheath 22 and a portion of the second dielectric 26 are received in the first outer cavity 56 between post 32 and tube 52. Embodiments of tube 52 are made of a nonconductive material such as an elastomeric material to prevent conductive contact with other conductive pieces in connector 14.

A first washer 58 may be sandwiched between first annular clamp 50 and second annular clamp 52 to potentially prevent contact between first clamp 50 and second clamp 52. Embodiments where the clamps 50, 52 are made of electrically conductive material, connector 14 may utilize the first washer 58 to electrically isolate the clamps 50, 52 because: (i) first clamp 50 can be in contact with third conductor 28; (ii) second clamp 52 can be in contact with second 26 conductor; and (iii) contact between the first clamp and the second clamp would therefore create an electrical "short" between the second and third conductors of the triaxial cable. First fastener 50 may include a slot or opening 60 therein to provide a radially flexible ring, such as a slotted, split or notched ring, to provide flexibility and compression which is imparted by connector 14. Fastener 50 may be tapered on the outer surface to create a smaller diameter at a first end 62 and a larger diameter at a second end 64.

Figure 7:
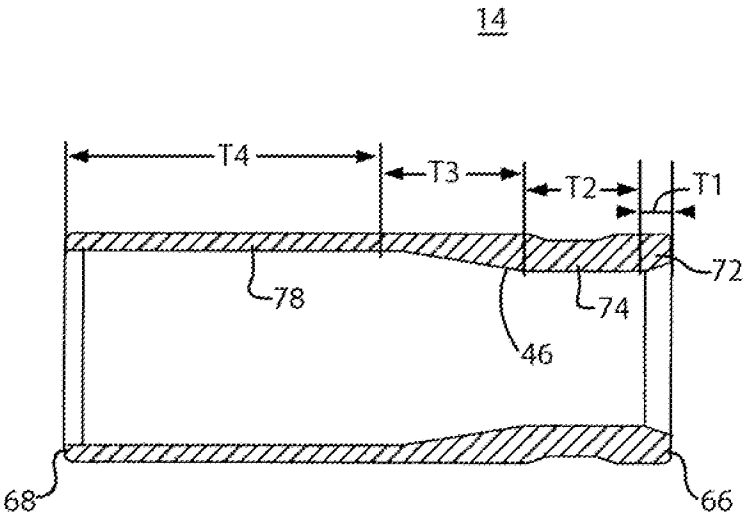
FIG. 7 is a sectional view of the outer housing of the audio jack connector device of FIG. 1.

As best shown in FIG. 7, connector 14 is a longitudinally extending tubular housing having: a cable self-centering portion 72; a compressing band portion 74; an inclined surface 46; and a wide open portion 78. Cable self-centering portion 72 has an inclined radially inwards facing surface to help gently guide prepared end 18 into the interior space of device 10 in the proper, centered axial alignment.

Wide open portion 78 has a radial inwards facing surface that has a relatively large diameter. This wide diameter may be sufficiently large so that it does not cause excessive radially inwards directed compressive force on the components of jack subassembly 12 so that: (i) there is room in the interior space of jack subassembly to receive the prepared end without requiring too much force in the axial direction to be provided by the user; and (ii) connector 14 can slide in the axial direction with respect to the jack subassembly. On the other hand, the interior diameter of wide open portion 78 can be sufficiently small so that there is a sufficient degree of friction between connector 14 and jack subassembly 12 so that the connector does not slide off of the jack subassembly in the A' direction (see FIG. 5) and device 10 can be shipped, sold and deployed in the field as a single piece assembly of parts.

Inclined surface 46 varies in diameter over its axial length from the wide open diameter of the wide open portion 78 at one of its ends, to a significantly smaller diameter at its other axial end. In this embodiment, the incline is a linear incline, but other geometries may be possible. As best understood by looking at FIGS. 5 and 7 together, when a user slides connector 14 in the axial direction A, the radially inwards facing surface of inclined surface 46 is driven to travel up the inclined radially outwards facing surface of fastener 50. In some embodiments, when connector 14 is moved axially over the cable end and the jack portion, the connector will be moved so far that its compressing band portion is fully and squarely over the outside of first fastener 50. In these embodiments, the inner space diameter of compressing band 74 must be large enough so it can be moved over the first fastener (by hand, or at least by tool), but small enough that it provides an appropriate level of compressive force to mechanically device 10 on end 14.

Connector 14 may be fabricated of a metal, conductive plastic or similar material. For example, connector 14 may be formed of brass with a nickel or an electroless nickel/TEFLON® finish. Connector 14 is sized and shaped to have a compression fit about certain components of jack portion 12, including: fastener 50, washer 58, tube 52, second washer 80, and a portion of a socket body 82. Socket body 82 is of tubular configuration having one end positioned radially within outer housing 46 and engaged by an interference or press fit with connector 14 and having a second end with opening or socket 84 for receiving phone plug style audio plug 19 (shown in FIG. 6).

As best shown in FIG. 4, the exterior of socket body 82 is characterized by three sections of different outside diameters. Proximate to first end 84 of socket body 82, a first section 86 has a cylindrical outer surface. As best shown in FIGS. 2 and 4, first end 84 abuts washer 80 inside of the interior space of connector 14. Second section 88 of socket body 82 is characterized by an exterior stepped section 90, which may act as a stopping point when a user slides connector 14 or jack subassembly 12 in the axial direction A to cause the compressive force that binds the cable to device 10. The third section 92 of socket body 82 may include a series of threads, serrations, or other mechanically interlocking features 94 for mounting connector device 10 to a panel (not shown). A nut 96 or similar component may be used to screw and secure the threaded third section 92 to a panel or electrical box, not shown. In other embodiments of the present invention, there may be no hardware, such as threads 94 and nut 96 to attach the connector device to a hole in a panel. For example, some embodiments may be used to allow users to make loose audio patch cables of precise and arbitrary custom lengths out in the field.

As shown in FIGS. 2 and 4, radially disposed around contact body 98 is an insulator 106. Insulator 106 is engaged radially to socket body 82 by an interference or a press fit. Insulator 106 includes a radially inwardly extending flange 116. As shown in FIG. 2, flange 116 of insulator 106 abuts flange 48 of post 32. Insulator 106 is preferably electrically insulative to prevent shorts through jack subassembly 12 between the first conductor path, which passes through contact body 98 as explained above, and the other conductor paths.

Inner housing 118 is preferably fabricated of a conductive material such as brass or a copper alloy, providing at least some degree of electromagnetic shielding, but also providing part of the second conduction path through device 10. As shown in FIGS. 4 and 5, inner housing 118 may include a series of slits or slots 119 thereon to further assist in maintaining audio plug 15 in socket body 82. As best shown in FIG. 2, sandwiched between inner housing 118 and socket body 82 is an insulator 120, configured for an interference fit with socket body 82 and inner housing 118. Insulator 120 provides insulation and prevents shorting between the third conduction path and the conductive inner housing 118 (which is part of the second conductor path).

Furthermore, inner housing 118 and post 32 are separate components in connector device 10, and inner housing 118 may be press-fitted onto the outer surface section 32*c* of post 32. Post 32 is fabricated of a conductive material such as brass and inner housing 118 may be fabricated of a conductive plastic or metal or other suitable material. In one embodiment, inner housing 118 is formed of brass or a copper alloy for ease of machining. In an alternative embodiment, inner housing 118 and post 32 can be formed integrally as a single piece.

In pre-assembled (or first) position, as illustrated in FIGS. 2 and 5, connector 14 is secured onto socket body 82 of jack subassembly 12 by an interference or press fit. In this manner, device 10 is thus in the form of a single piece assembly even prior to its later installation on a cable end. This reduces the risk of any of the components being dropped or otherwise mishandled during handling and installation, as is prevalent in known designs, which have many separate components that must be fit together at the time of installation. An example of this is shown in U.S. Pat. No. 6,786,774.

The preparation of cable end 18 for assembly with device 10 will now be explained. The end of a triaxial cable 18 is prepared by exposing a central core portion including the center conductor 20, insulator core 24 (and optionally foil). First conductive sheath 22 is folded over second dielectric layer 26. Second conductive sheath 28 is folded over outer sheath jacket 30.

As mentioned above, in the assembled position, connector 14 compresses first fastener 50. It may additionally compress tube 52 and first washer 58, to provide further clamping force on the cable. Embodiments of jack portion 12 may clamp the cable 360 around in the angular direction, but this is not necessarily required, so long as there is sufficient mechanical and electrical connection between the components of the cable and the connector device.

A protective electromagnetic shield for conductive sheath 22, preventing interference from external electrical conductors, is provided by clamp 50, connector 14 and socket body 82. This protective electromagnetic shield extends the axial and circumferential length of the audio jack connector device 10. It is possible that the electromagnetic shield contains slots, perforations or other openings in any of the components that comprise the shield, which design will still provide a protective shield substantially along the axial and circumferential length of the shield.

Post 32 provides good electrical connection for first conductive sheath (or second conductor) 22. Additionally, post 32 provides the added benefit of adding support and integrity to the connector device 10 and further provides strength to the cable connection. In fact, the tensile and/or mechanical strength of the connector device 10 may be greater than the breaking strength of the cable itself. Accordingly, the connector devices are able to withstand high stresses and strains during use, e.g., those great enough to break the cable. The cable will typically fail or break before the connector device. Depending on the tensile or mechanical strength of the connector relative to the cable, if the connector device 10 and cable 18 are subjected to stress, strain or other pressure, the cable 18 will typically break or tear before the connector device 10 fractures or before the cable is released from the grip of the connector device. The connector devices described herein does not tend to create stress concentrations, but distributes the stress more evenly around the circumference of the cable.

Further embodiments provide a device having a series of conductors concentrically arranged in the device. The outer housing 46, clamp 50 and socket body 82 of the device 10 can maintain the continuity of the electromagnetic shield provided by the outer conductor of the multi-conductor coaxial cable. The shield may extend 360° completely or substantially the full axial and circumferential length of the connector, from the socket body to the outer conductor of the multi-conductor coaxial cable. Additionally, the preassembled single piece assembly type construction of the devices prevent loss or mishandling of components during installation.

III. Embodiment of FIG. 8

Figure 8:
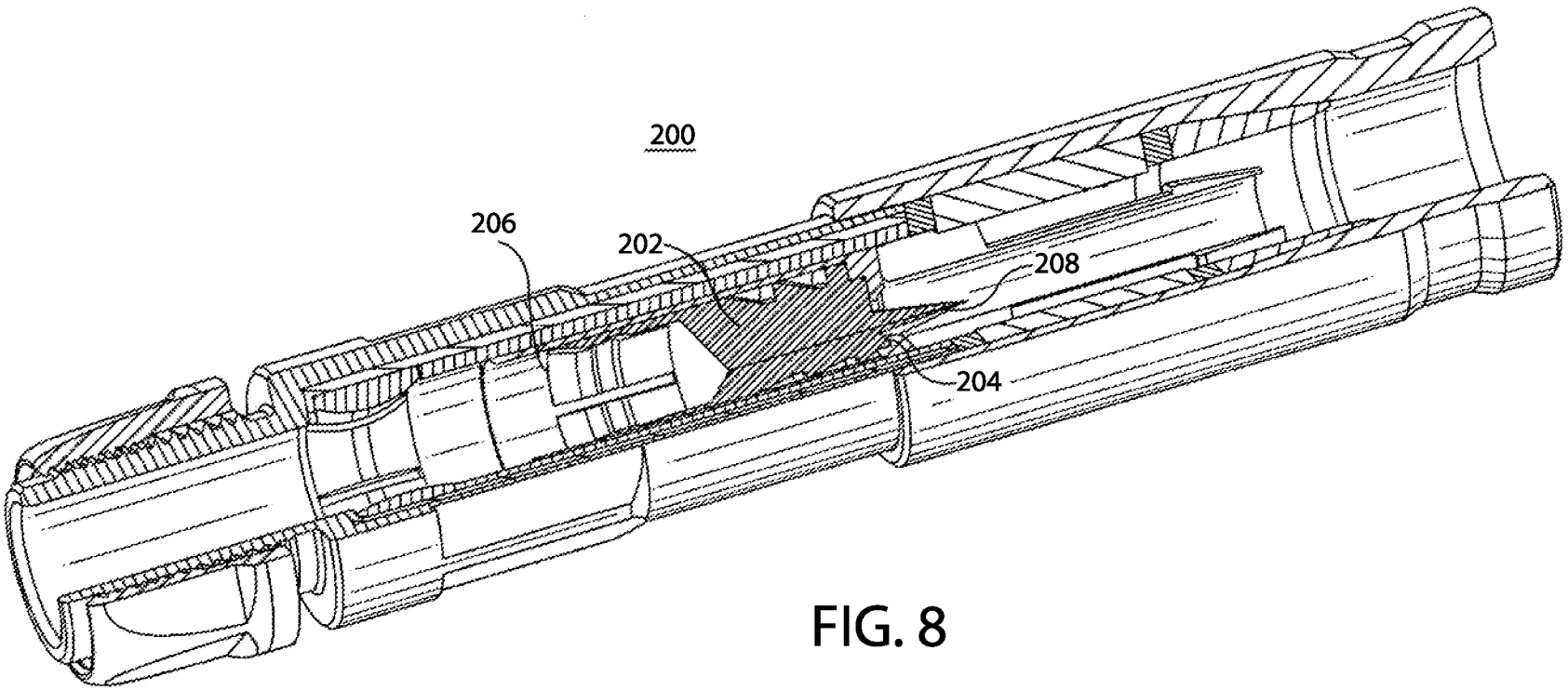
FIG. 8 is a sectional view of another embodiment of the audio jack connector.

Reference is made to FIG. 8, which shows another example of an audio jack connector device 200 having a contact body 202 for making electrical contact with a center conductor. Contact body 202 includes a first end 204 and a second end 206. Contact body 202 includes a spiked contact 208 extending from first end 204. Spiked contact 208 is used when a cable has a center conductor fabricated of a plurality of strands instead of a single central wire. Spiked contact 208 makes contact with the plurality of strands of the center conductor by piercing the cable and contacting the strands in the center of the cable. Device 10, 200 is not limited to a specific type of contact, as discussed above.

IV. Embodiment of FIGS. 9 and 10

Figure 9:
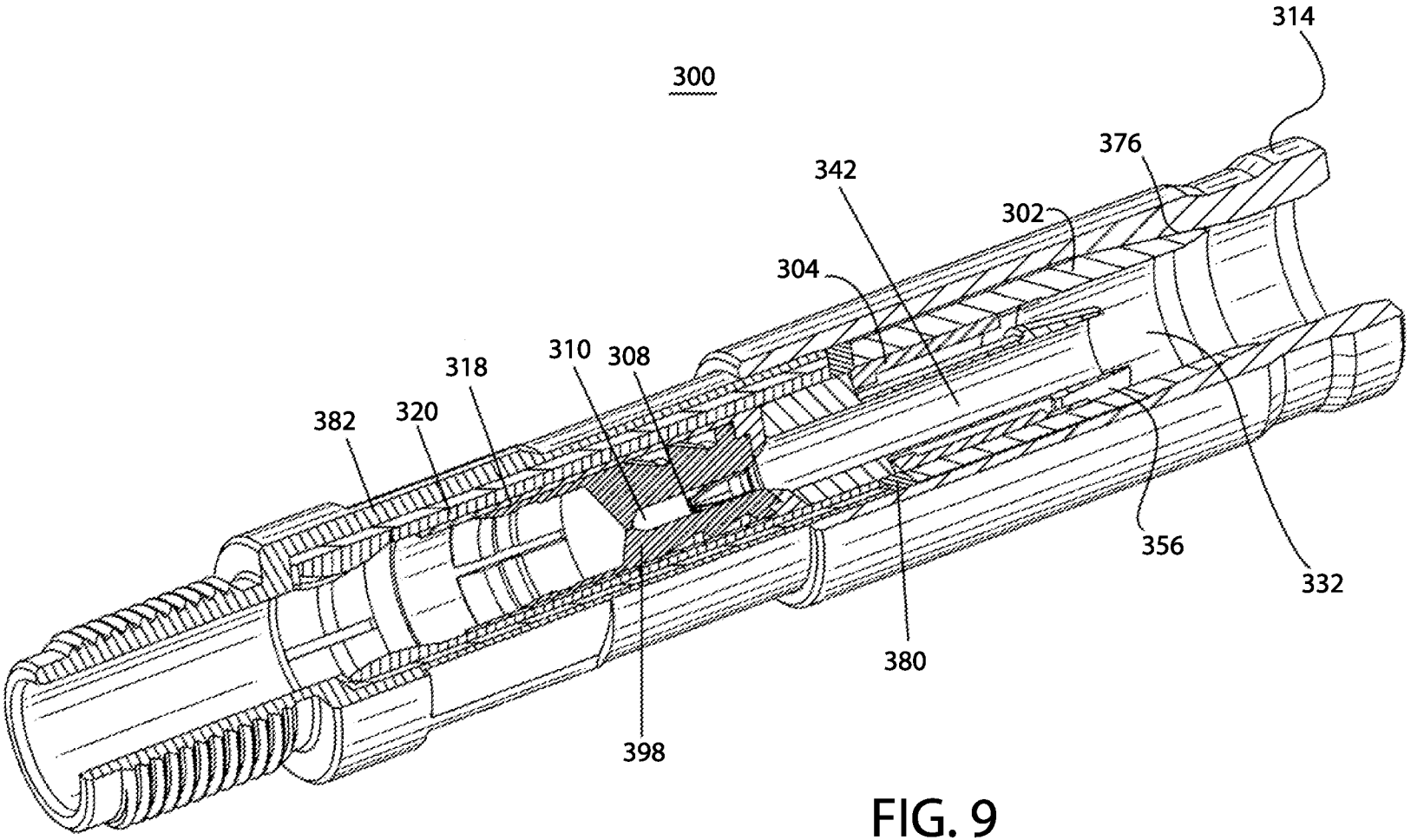
FIG. 9 is a sectional view of another embodiment of the audio jack connector device.
Figure 10:
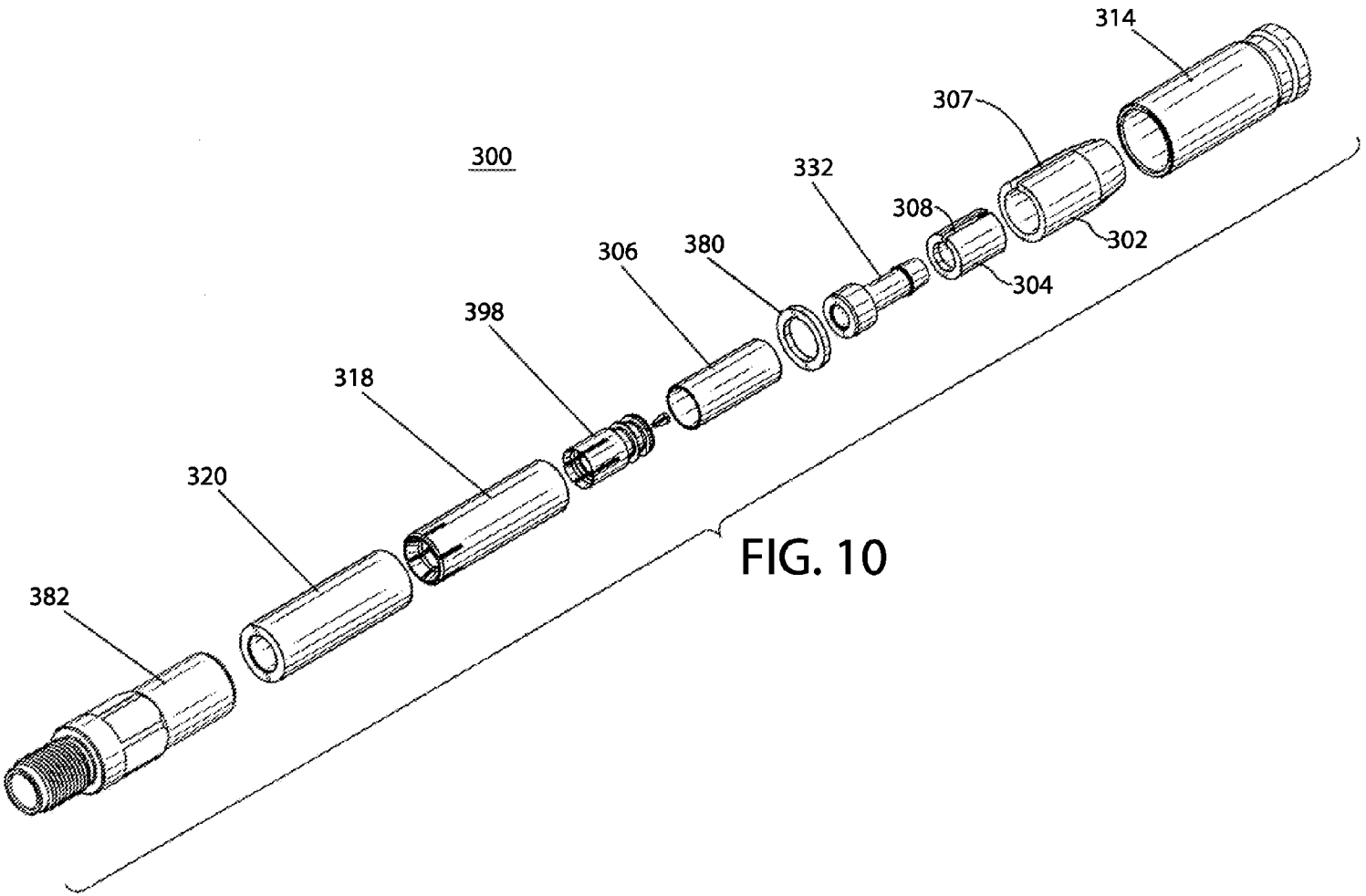
FIG. 10 is an exploded perspective view of the audio jack connector device of FIG. 9.

The connector device 300 shown in FIGS. 9 (assembly view) and 10 (exploded view) includes: connector 314; tubular body (or post) 332; first inner cavity 342; second inner cavity 356; first fastener 302 (including slot 307); second fastener 304 (including slot 308); first outer cavity 356; first washer 380; socket body 382; insulator 306; electrical socket component 308; bore 310; inner housing 318; insulator 320; and contact body 398. In addition to jack sub-assembly 12, FIGS. 2 and 4 also show connector 14, which includes: inclined surface 46; first end 66; second end 68 and connector interior space 70.

Audio plug connector device 300 is generally similar to device 10, except for fastener components 302 and 304. In device 300, connector 314 exerts radially inwards directed force on fasteners 302 and 304 as device 300 is moved from its unassembled position to its assembled position. Slots 307, 308 allow fasteners 302,304 to deform and thereby clamp the cable within their interior space. As shown in FIG. 9, second fastener 304 is located in the interior space of first fastener 302. Fastener 304 is located around a portion of post 332, but spaced apart from it in the radial direction to form first outer cavity 356. It is preferable that clamp 304 is fabricated of a nonconductive material such as an elastomeric material to prevent contact with other conductive pieces in connector device 300.

Embodiments of FIGS. 1-12 may make possible one or more of the following advantageous features: (i) field manufacturable audio coaxial cable/connector sub-assembly that can be made without the use of solder and without the use of set screws; (ii) field manufacturable audio coaxial cable/connector sub-assembly that is practical and easy-to-use, (iii) field manufacturable audio coaxial cable/connector sub-assembly that is relatively less susceptible to electrical shorts and other malfunctions that can be cause by the use of non-coaxial terminals placed in close proximity to each other, (iv) field manufacturable audio coaxial cable/connector sub-assembly that is relatively compact in its post-assembly state, (v) field manufacturable cable/connector sub-assembly that can accommodate three, or even four, conductor path cables, (vi) field manufacturable cable/connector sub-assembly with reduced length to reduce strain and stress in the cable during use; and/or (vii) field manufacturable cable/connector sub-assembly with improved usability of audio jacks in narrowly spaced equipment cabinets.

V. General Remarks

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A coaxial cable connector device for assembly with a prepared end of a coaxial cable having at least a first conductor, a second conductor, and a third conductor and for attachably detachable use with a single pronged plug, the device comprising:

a jack having a first contact, a second contact, and a third contact and an interior surface that defines an interior space, the jack configured to form an attachably detachable connection with the plug so that the single prong of the plug is accommodated within the interior space;

a first conduction path formed by electrically connecting the first conductor of the coaxial cable to the first contact of the jack;

a second conduction path formed by electrically connecting the second conductor of the coaxial cable to the second contact of the jack;

a third conduction path formed by electrically connecting the third conductor of the coaxial cable to the third contact of the jack; and a deformable member that is configured to cause clamping of the coaxial cable when in an assembled position, the deformable member physically contacting the third contact of the jack;

wherein the first contact of the jack forms a portion of the interior surface and faces the interior space;

wherein the second contact of the jack forms a portion of the interior surface and faces the interior space;

wherein the third contact of the jack forms a portion of the interior surface and faces the interior space.

2. The device of claim 1 wherein:

the second conduction path is coaxial with the first conduction path and surrounds the first conduction path around at least substantially 360 degrees in the angular direction; and the third conduction path is coaxial with the second conduction path and surrounds the second conduction path around at least substantially 360 degrees in the angular direction.

* * * * *